US006193586B1

(12) United States Patent
Park et al.

(10) Patent No.: US 6,193,586 B1
(45) Date of Patent: Feb. 27, 2001

(54) METHOD AND APPARATUS FOR GRINDING WAFERS USING A GRIND CHUCK HAVING HIGH ELASTIC MODULUS

(75) Inventors: Bae-seung Park; Jin-heung Kim; Do-yun Hwang, all of Kyonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/228,037

(22) Filed: Dec. 24, 1998

(30) Foreign Application Priority Data

Feb. 11, 1998 (KR) ..... 98-3971

(51) Int. Cl.[7] ..... B24B 7/22

(52) U.S. Cl. ..... 451/41; 451/57; 451/65; 451/388

(58) Field of Search ..... 451/65, 57, 388, 451/411, 449, 41

(56) References Cited

U.S. PATENT DOCUMENTS 5,329,732 * 7/1994 Karlsrud et al. ..... 51/131.5
5,498,199 * 3/1996 Karlsrud et al. ..... 451/289
5,609,719 * 3/1997 Hempel ..... 156/636.1
5,797,789 * 8/1998 Tanaka et al. ..... 451/289
5,823,853 * 10/1998 Bartels et al. ..... 451/5
5,906,754 * 5/1999 Appel et al. ..... 216/88
5,954,888 * 9/1999 Gupta et al. ..... 134/3
5,975,986 * 11/1999 Allen et al. ..... 451/5

* cited by examiner

*Primary Examiner*—Joseph J. Hail, III
*Assistant Examiner*—William Hong
(74) *Attorney, Agent, or Firm*—Jones Volentine, LLC

(57) ABSTRACT

A method and apparatus for grinding wafers without using an ultraviolet tape attached to the front face of the wafer reduces manufacturing costs, simplifies the grinding process and protects the semiconductor chips formed on the front face of the wafer from being damaged by static electricity. The grinding apparatus uses a grind chuck formed of a soft material having a high elastic modulus and a rising groove formed in the grind chuck. Deionized water is supplied onto the wafer from a first direction. Simultaneously, deionized water or air is supplied into the rising groove of the grind chuck from a second direction opposite to the first direction. The circumferential edge of the wafer overlaps the rising groove, such that the simultaneous supply of deionized water and/or air from the two directions protects the front surface of the wafer from being contaminated by silicon dust. The soft material of the grind chuck also protects the front surface of the wafer from being damaged by pressure from the grind unit.

11 Claims, 6 Drawing Sheets

METHOD AND APPARATUS FOR GRINDING WAFERS USING A GRIND CHUCK HAVING HIGH ELASTIC MODULUS

BACKGROUND OF THE INVENTION

1. Field of the Invention

The present invention relates to a method and apparatus for grinding wafers using a grind chuck having a high elastic modulus. The present invention relates more particularly to an apparatus and method for grinding wafers capable of protecting semiconductor chips formed on the front face of the wafer, without using an ultraviolet tape attached thereto, while protecting the semiconductor chips from being contaminated and damaged.

2. Description of the Related Art

Generally, thin semiconductor packages are produced by forming semiconductor chips on the front surface of a wafer and grinding the rear face of the wafer by means of a grinder.

A conventional wafer grinding machine includes a process chamber which provides space for performing the grinding operation. A grind table is installed partially inside and partially outside of the process chamber. A plurality of grind chucks for holding a wafer by suction force are mounted on the grind table. A first grind unit installed in the process chamber first grinds the rear face of the wafer held by the grind chucks until the wafer has a predetermined thickness. A second grind unit grinds the first-ground rear face of the wafer again until the wafer has a desirable thickness. An intake and exhaust groove is formed through the grind table to establish a vacuum pressure to hold the wafer on the grind chuck and to exhaust air therethrough so as to release the wafer from the grind chuck. A deionized water supply duct is also employed in the wafer grinding machine to remove heat generated while the wafer is ground by spraying deionized water onto the wafer.

A porous portion filled with a plurality of pores is formed in the central region of the grind chuck. The porous portion corresponds to the intake and exhaust groove so that the wafer can be held by or detached from the grind chuck by suctioning or exhausting air. The grind chuck is formed of ceramic material having a high hardness. An upper surface of the grind chuck is periodically reground so that the flatness of the grind chuck can be consistently maintained at a fixed level.

Conventionally, an ultraviolet tape is attached to the front face of the wafer where the semiconductor chips are formed. When the rear face of the wafer is ground, the ultraviolet tape and the flow of deionized water prevent silicon dust from contacting the front face, and thereby protect the semiconductor chips formed on the front face of the wafer from being contaminated by the silicon dust. Furthermore, the ultraviolet tape has a cushioning effect which protects the semiconductor chips from stress caused by the grinding operation.

After the ultraviolet tape is attached to the front face of the wafer, the wafer is loaded on the grind chuck in such a manner that the surface of the grind chuck is in contact with the front face of the wafer. Then, a vacuum pressure is generated in the intake and exhaust groove. As a result, the wafer is held on the grind chuck.

Thereafter, the grind chuck with the wafer held thereon is moved to the first grind unit inside the process chamber by rotating the grind table. Deionized water is then applied to the wafer. While rotating at a fixed velocity, the first grind unit moves downwardly to the wafer whereby the rear face of the wafer is ground to a predetermined thickness. Since the first grind unit rotates slowly, the first grinding operation leaves a rough rear face on the wafer.

The grind table is rotated again, and the first-ground wafer is transferred to a location beneath the second grind unit. Then, while rotating at a higher velocity than the first grind unit, the second grind unit moves downwardly to the transferred wafer in the same manner as the first grinding operation. As a result, the rear face of the wafer is secondly ground to a desirable thickness. Since the second grind unit rotates at a higher velocity than the first grind unit, the second grinding operation leaves the rear face of the wafer smooth.

When the wafer is ground to the desirable thickness through the first and the second grinding operations, the wafer is unloaded from the grind chuck. The front face of the wafer is then exposed to ultraviolet ray to reduce the adhesion of the ultraviolet tape attached to the front face of the wafer. Thereafter, a removing tape having a higher adhesion than the ultraviolet tape is attached to the ultraviolet tape to remove the ultraviolet tape from the front face of the wafer.

However, such a grinding process carried out after an ultraviolet tape is attached to the front face of the wafer suffers several problems. First, since the ultraviolet tape is expensive, the manufacturing costs of the products increase. Second, the ultraviolet tape attached to the front face of the wafer incurs cumbersome additional steps of exposing the wafer to ultraviolet rays, attaching a removing tape to the ultraviolet tape, and removing the ultraviolet tape using the removing tape. This results in a complicated grinding process, increased operation time and reduced productivity.

Third, the air between the front face of the wafer and the adhesive tape is repeatedly contracted and expanded by the heat generated while the rear face of the wafer is ground and the deionized water is sprayed to remove the heat generated by the grinding. As a result, a gap is generated between the front face of the wafer and the adhesive tape. Deionized water containing silicon dust may be introduced into the gap, and the wafer may be contaminated by the silicon dust.

Fourth, since the ultraviolet tape is coated with a vinyl, static electricity occurs when the ultraviolet tape rubs against other objects. The static electricity may damage the semiconductor chips formed on the wafer.

SUMMARY OF THE INVENTION

Therefore, it is an object of the present invention to reduce manufacturing costs of semiconductor chips, simplify a wafer grinding process and prevent static electricity from occurring by removing the step of attaching an ultraviolet tape to the front face of a wafer with semiconductor chips formed thereon.

It is another object of the present invention to protect the semiconductor chips from being contaminated or damaged due to removal of the ultraviolet tape by improving the material and structure of a wafer grinding machine.

To achieve the above objects and other advantages, the present invention provides a method for grinding the rear face of a wafer. According to the method, the wafer is loaded on a grind chuck in such a manner that the front face of the wafer is in contact with the surface of the grind chuck. The wafer is held on the grind chuck by a vacuum suction force through a suction hole formed in the grind chuck. The grind chuck with the wafer held thereon moves toward a first grind unit. At the same time that deionized water is sprayed at the rear face of the wafer to remove heat generated while the wafer is being ground, deionized water or air rises in the direction opposite to the deionized water supplied direction through a rising groove formed along the edge of the grind chuck. After the wafer is ground to the first thickness by a first grind unit, the wafer is transferred to a location corresponding to a second grind unit. Then, the wafer is ground again to a second thickness, i.e., a desirable thickness, by the second grind unit in the same manner as the first grinding step. When the wafer is completely ground to the desirable thickness, the wafer is unloaded from the grind chuck.

The present invention also provides a wafer grinding machine for performing the above steps. The wafer grinding machine comprises: a process chamber for providing a space for performing a wafer grinding process; a grind table installed partially inside and partially outside of the process chamber; a plurality of grind chucks mounted on the grind table for holding the wafer thereon by a vacuum suction force; a deionized water supply duct for applying deionized water to the wafer held by the grind chuck; a first grind unit for grinding the wafer to a first thickness; and a second grind unit for grinding the first-ground wafer to a second thickness. The grind chuck includes a body having a predetermined thickness and a shape corresponding to the wafer; a ring-shaped porous portion formed in the central region of the body and including a plurality of suction pores; and a ring-shaped rising groove formed along the peripheral edge of the body. A grind chuck accommodating groove for accommodating the grind chuck is formed in the grind table. Corresponding to the porous portion, an intake and exhaust groove is formed in the grind chuck accommodating groove. The rising groove is connected to a fluid supply duct formed in the grind chuck accommodating groove through a rise hole formed through the body of the grind chuck. The intake and exhaust groove is connected to a vacuum pump and a blower through an intake and exhaust hole formed through the grind table.

Preferably, a connecting duct projects from the bottom of the grind chuck accommodating groove and connects the fluid supply duct to the rise hole. A plurality of coupling projections are formed on the bottom of the body. A plurality of coupling grooves corresponding to the plurality of coupling projections are formed in the bottom of the grind chuck accommodating groove.

Preferably, the inner diameter of the ring-shaped rising groove is equal to or a little smaller than the diameter of the wafer.

In addition, preferably, deionized water having a resistivity of 16 MΩ or air is supplied through the fluid supply duct.

Preferably, the grind chuck is formed of polytetrafluoruethylene or rubber that is a soft material having a high elastic modulus.

Another embodiment of the wafer grinding machine includes a process chamber for providing a space for performing a wafer grinding process; a grind table installed partially inside and partially outside of the process chamber; a plurality of grind chucks mounted on the grind table for holding the wafer thereon by a vacuum suction force; a deionized water supply duct for applying deionized water to the wafer held by the grind chuck; a first grind unit for grinding the wafer to a first thickness; and a second grind unit for grinding the first-ground wafer to a second thickness; a dam surrounding the grind chuck forming a space in which the first and second grind units can operate; and a deionized water exhaust hole formed through the grind table in the space defined by the dam. The grind chuck includes a body having a predetermined thickness and a shape corresponding to the wafer; and a ring-shaped porous portion formed in the central region of the body and having a plurality of suction pores. A grind chuck accommodating groove for accommodating the grind chuck is formed in the grind table. Corresponding to the porous portion, an intake and exhaust groove is formed in the grind chuck accommodating groove. The intake and exhaust groove is connected to a vacuum pump and a blower through an intake and exhaust hole formed through the grind table. Preferably, first and second branch ducts for applying deionized water to the wafers corresponding to the first and the second grind units, respectively, are integrally connected to an end of the deionized water supply duct.

Preferably, the space formed by the dam fills with deionized water from the deionized water supply duct such that the wafer held by the grind chuck is submerged in the deionized water within the dam.

BRIEF DESCRIPTION OF THE ATTACHED DRAWINGS

The present invention will be described with reference to the accompanying drawings in which like reference symbols indicate the same or similar components, wherein.

DETAILED DESCRIPTION OF THE PREFERRED EMBODIMENTS

The objects, characteristics and advantages of the above-described invention will be more clearly understood referring to the attached drawings.

Figure 1:
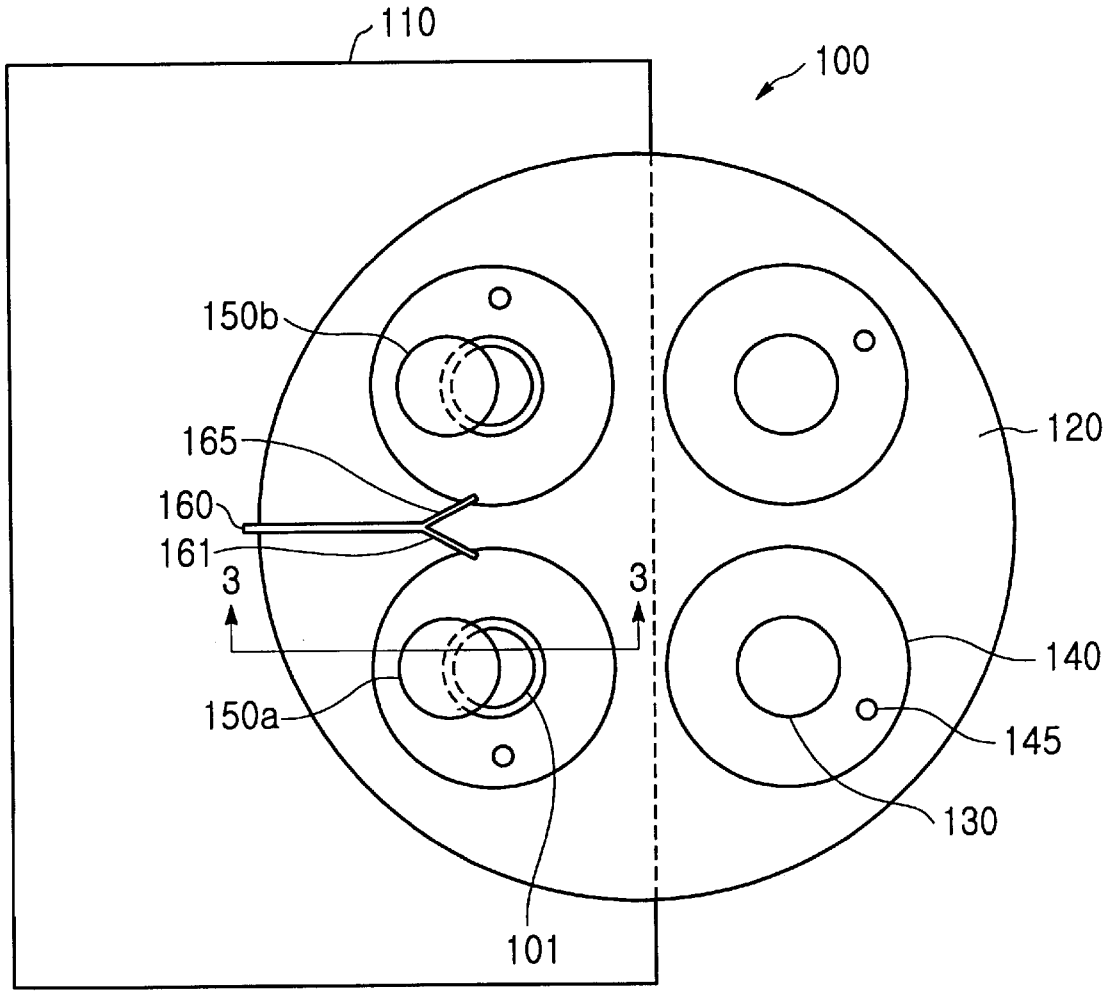
FIG. 1 is a plan view of a wafer grinding machine according to a first embodiment of the present invention.
Figure 2:
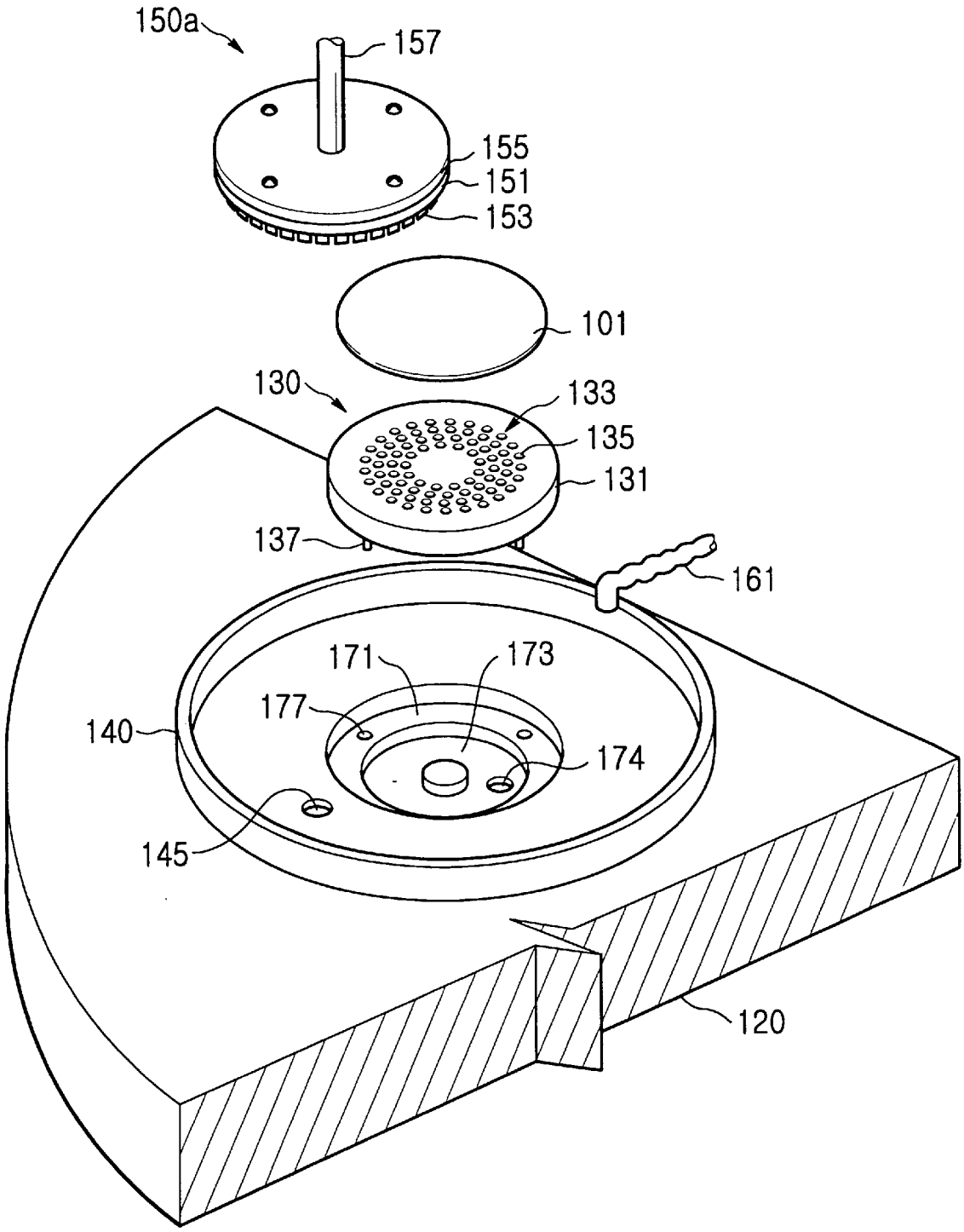
FIG. 2 is an exploded perspective view, partially cut away, of the grind table, grind chuck and grind unit of the wafer grinding machine as shown in FIG. 1.
Figure 3:
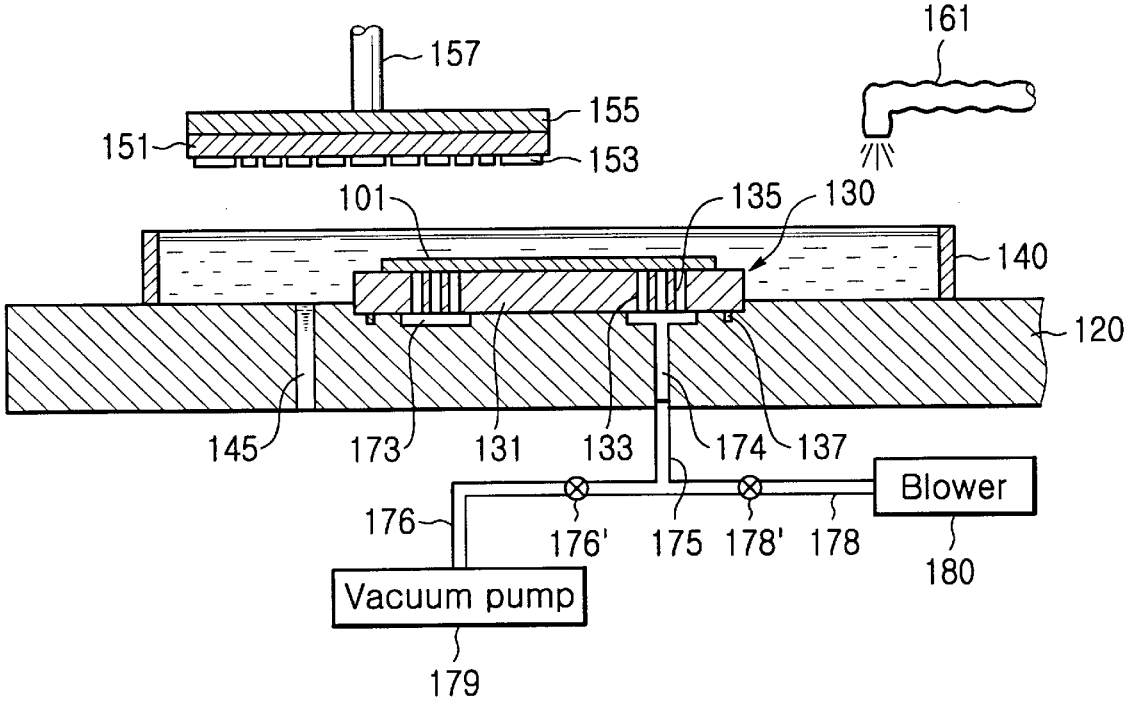
FIG. 3 is a cross-sectional view taken along lines 3—3 in FIG. 1.

Referring to FIGS. 1 through 3, the structure and operation of a wafer grinding machine 100 according to a first embodiment of the present invention will be described.

The wafer grinding machine 100 comprises: a process chamber 110 for providing a space for performing a wafering grinding process; a grind table 120 installed partially inside and partially outside of the process chamber 110 and rotating in a predetermined direction by a motor (not shown); a plurality of grind chucks 130 mounted on the grind table 120, for holding a wafer 101 by a vacuum suction force; a deionized water supply duct 160 for spraying deionized water onto the wafer 101 to remove heat generated while the rear face of the wafer 101 is being ground; a first grind unit 150*a* installed in the process chamber 110, for grinding the rear face of the wafer 101 to a first thickness; a second grind unit 150*b* for grinding the first-ground rear face of the wafer 101 to a second thickness; and a dam 140 surrounding the grind chuck 130 so that the first and second grind units 150*a* and 150*b* can grind the wafer 101.

the grind table 120 has a circular shape. A half portion from a center of the grind table 120 is located in the process chamber 110 and the other half portion thereof is located out of the process chamber 110 as shown in FIG. 1.

As shown in FIG. 2, grind chuck accommodating grooves 171 for accommodating the respective grind chucks 130 are formed in the grind table 120. A plurality of coupling grooves 177 for use in fixing the grind chuck 130 are formed in the bottom of the grind chuck accommodating groove 171 along the edge of the grind chuck accommodating groove 171. In addition, a ring-shaped intake and exhaust groove 173 having a predetermined depth is formed at the central region in the grind chuck accommodating groove 171. An intake and exhaust hole 174 is formed in the intake and exhaust groove 173 through the grind table 120. An intake and exhaust duct 175 is fitted into the intake and exhaust hole 174 as shown in FIG. 3. The intake and exhaust duct 175 is divided into two branches: one branch is a vacuum duct 176 connected to a vacuum pump 179; and the other branch is an air supply duct 178 connected to a blower 180. Opening the closing valves 176' and 178' are installed in the vacuum duct 176 and the air supply duct 178, respectively.

At any one time, two of the grind chucks 130 mounted on the grind table 120 are located outside of the process chamber 110, and the other two of the grind chucks 130 mounted on the grind table 120 are located inside the process chamber 110. The two grind chucks 130 located outside of the chamber 110 are used in loading the unloading the wafer 101. The two grinding chucks 130 located inside the process chamber 110 are used in grinding the wafer 101 by the first and the second grind units 150*a* and 150*b*.

Each grind chuck 130 comprises: a body 131 having a predetermined thickness and formed in a shape corresponding to the wafer 101; a ring-shaped porous portion 133 with a plurality of pores 135 formed in the central region of the body 131 corresponding to the intake and exhaust groove 173, for holding or releasing the wafer 101 by a vacuum suction force; and a plurality of coupling projections 137 formed at the bottom of the body 131 corresponding to the coupling grooves 177, for use in fixing the grind chuck 130 into the grind chuck accommodating groove 171. The grind chuck 130 is formed of a soft material having a high elastic modulus to prevent semiconductor chips formed on the front face of the wafer 101 from being scratched or stressed by pressure imposed by the first and second grind units 150*a* and 150*b*. Preferably, the soft material having a high elastic modulus is polytetrafluoruethylene or rubber.

As shown in FIGS. 2 and 3, the deionized water supply duct 160 is a corrugated duct allowing easy shrinkage and slackness. An end of the deionized water supply duct 160 is connected to a deionized water supply (not shown) and the other end thereof is divided into two branches: one is a first branch duct 161 for applying deionized water to the wafer 101 corresponding to the first grind unit 150*a*; and the other is a second branch duct 165 for applying deionized water to the after 101 corresponding to the second grind unit 150*b*. Preferably, the deionized water sprayed to cool the grinding heat has a resistivity of 16 MΩ to prevent static electricity occurrence on the wafer 101.

The first and second grind units 150*a* and 150*b* are installed in such a manner that their central axes are offset from the central axes of the grind chucks 130, such that the circumferential edge of each first and second grind unit 150*a* and 150*b* is aligned with a central axis of one of the grind chucks 130 as shown in FIG. 1. The first and second grind units 150*a* and 150*b* rotate on their own axes and revolve about the central axis of the grind chuck 130, simultaneously.

As shown in FIG. 2, the first and second grind units 150*a* and 150*b* each comprise: a grinder 151 with diamond resigns 153 serially mounted on the bottom thereof along the periphery, for grinding the rear face of the wafer 101; and a wheel 155 for rotating the grinder 151. The grinder 151 is coupled with the bottom of the wheel 155. A shaft 157 of a motor (not shown) is fixed to the center of the top of the wheel 155 so that the wheel 155 can rotate the grinder 151 by the operation of the motor.

The dam 140 surrounding the grind chuck 130 has a predetermined height and is spaced apart from the grind chuck 130 so as not to interfere with revolution of the first and second grinding chucks 150*a* and 150*b* about the grind chuck 130. A deionized water exhaust hole 145 is formed through a location in the dam 140 corresponding to the deionized water supply duct 160. Deionized water carrying silicon dust is exhausted through the deionized water exhaust hole 145. Preferably, the dam 140 is high enough that the wafer 101 held by the grind chuck 130 is submerged in the deionized water within the dam 140.

The operation of the wafer grinding machine 100 will be described hereinafter. First, after semiconductor chips have been completely formed on the front face of a wafer 101, the wafer 101 is loaded onto the grind chuck 130 located outside of the process chamber 110 in such a manner that the front face of the wafer 101 with the semiconductor chips formed thereon is brought into contact with the surface of the grind chuck 130.

When the wafer 101 is loaded onto the grind chuck 130, the opening and closing valve 176' installed in the vacuum duct 176 is opened whereby the intake and exhaust hole 174 and the intake and exhaust groove 173 are exposed to a vacuum. When the intake and exhaust groove 173 is in a vacuum state, the wafer is held onto the grind chuck 130 by vacuum suction force through the pores 135 of the porous portion 133 formed corresponding to the intake and exhaust groove 173.

When the wafer 101 is held on the grind chuck 130 by the vacuum suction force, the grind table 120 is rotated 90 degrees in the clockwise direction. As a result, the grind chuck 130 with the wafer 101 held thereon is moved to a location under the first grind unit 150*a* installed inside the process chamber 110.

Then, deionized water having a resistivity of more than 16 MΩ is sprayed into the space surrounded by the dam 140 through the first branch duct 161 until the wafer 101 held by the grind chuck 130 is submerged in the deionized water. Thereby, the grinding heat generated while the rear face of the wafer is being ground can be removed, and the semiconductor chips formed on the front face of the wafer 101 can be protected from being contaminated by silicon dust.

Thereafer, the wheel 155 coupled with the grinder 151 is rotated at a velocity of approximately 300 rpm and the first grind unit 150*a* is moved downwardly to the wafer 101 held on the grind chuck 130 by operation of the motor of the first grind unit 150*a*. When the diamond resins 153 are brought into contact with the rear face of the wafer 101, the rear face of the wafer 101 is ground by the pressure of the first grind unit 150*a* and the rotation power of the grinder 151 since the diamond resins 153 are harder than silicon. Through the first grinding step, the wafer 101 originally having a thickness of approximately 720 μm is ground to a first thickness, e.g., a thickness of approximately 420 μm.

While the rear face of the wafer 101 is ground by the diamond resins 153, silicon dust is generated. The silicon dust mixes with the deionized water contained in the dam 140 and flows along with the deionized water. The deionized water from the first branch duct 161 flows toward and is discharged through the deionized water exhaust hold 145. Accordingly, the front face of the wafer 101 with the semiconductor chips is protected from being contaminated by the silicon dusts.

When the wafer 101 is completely ground to the first thickness, the grind table 120 is rotated 90 degrees in the clockwise direction. As a result, the first-ground wafer 101 is moved to the location corresponding to the second grind unit 150*b*. Deionized water is sprayed into the space surrounded by the dam 140 through the second branch duct 165 until the wafer 101 held on the grind chuck 130 is submerged in deionized water. Then, the motor of the second grind unit 150*b* is operated to rotate the wheel 155 coupled with the grinder 151 at a velocity of approximately 200 rpm and move the second grind unit 150*b* downwardly to the grind chuck 130 holding the wafer 101. When the second grind unit 150*b* is moved downwardly to the wafer 101, the diamond resins 153 of the grinder 151 are brought into contact with the rear face of the wafer 101. The diamond resins 153 grind the rear face of the wafer 101 in the same manner as previously described with respect to the first grind unit 150*a*. The rear face of the wafer 10 is ground until the wafer 101 has a second thickness, e.g., a thickness of approximately 380 $\mu$m.

The grind table 120 is rotated 90 degrees in the clockwise direction again. Then, the opening and closing valve 176' installed in the vacuum duct 176 is closed and the opening the closing valve 178' installed in the air supply duct 178 is opened to supply air through the intake and exhaust duct 175. When the air is supplied through the intake and exhaust duct 175, the wafer 101 that was vacuum-held on the grind chuck 130 is released from the grind chuck 130 by the air supplied from the porous portion 133. Then, the second-ground wafer 101 is unloaded.

Since the grind chuck 130 is formed of a soft material, and not a hard ceramic material as in the conventional grinding machine, the flatness of the surface of the grind chuck 130 cannot be enhanced by grinding the surface of the grind chuck 130 by the first and the second grind units 150*a* and 150*b*. Accordingly, the grind chuck 130 is replaced with a new grind chuck 130 on a periodic basis so that the flatness of the grind chuck 130 can be ensured.

Figure 4:
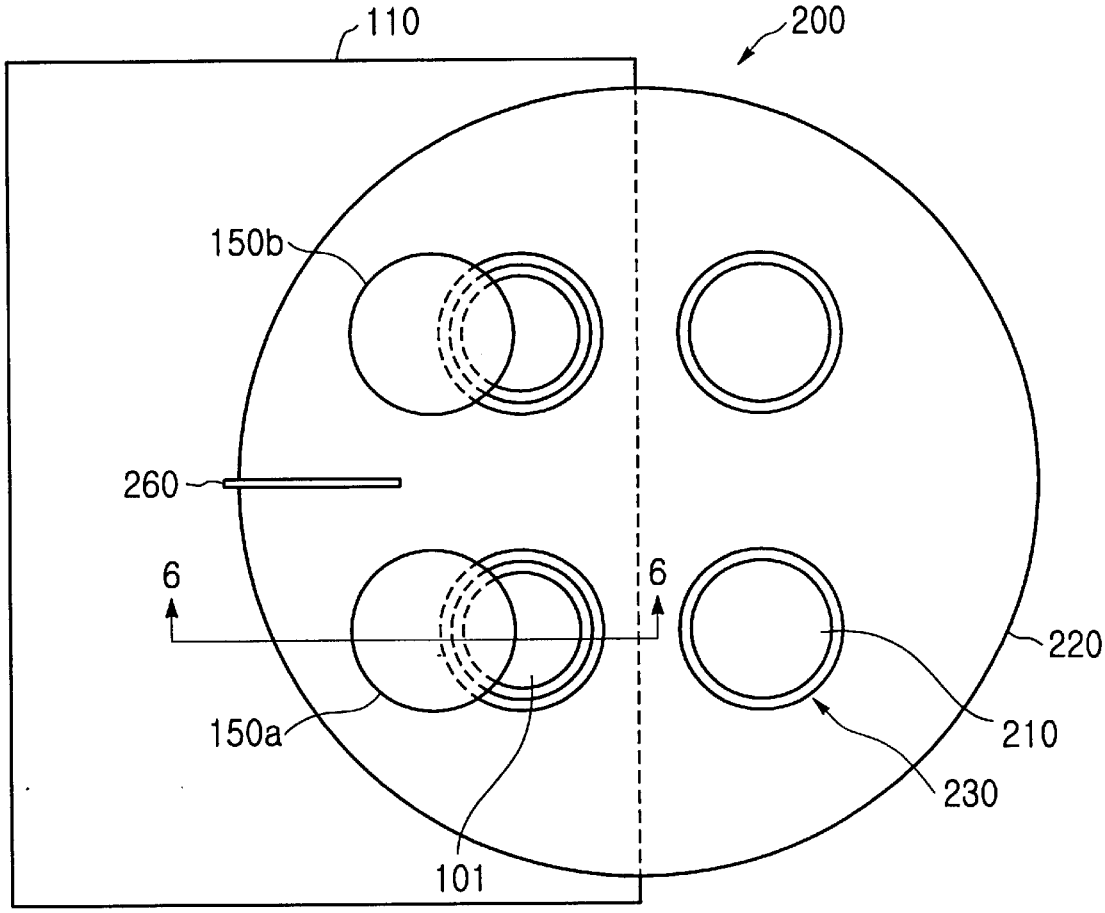
FIG. 4 is a plan view of a wafer grinding machine according to a second embodiment of the present invention.

Another embodiment of a wafer grinding machine according to the present invention will be described with reference to FIGS. 4 through 6.

The wafer grinding machine 200 according to the second embodiment of the present invention comprises: a process chamber 110 for providing a space for performing a wafer grinding process; a grind table 220 installed partially inside and partially outside of the process chamber 110 and rotating in a predetermined direction by a motor (not shown); a plurality of grind chucks 230 mounted on the grind table 220, for holding a wafer 101 by a vacuum suction force; a deionized water supply duct 260 for spraying deionized water onto the wafer 101 to remove heat generated while the rear face of the wafer 101 is ground; a first grind until 150*a* installed in the process chamber 110, for grinding the rear face of the wafer 101 to a first thickness; and a second grind unit 150*b* for grinding the first-ground rear face of the wafer 101 to a second thickness.

Except for the structures of the grind table 220 and the grind chuck 230, the wafer grinding machine 200 is the same as the previously described wafer grinding machine 100. Accordingly, a description will be provided only for the structures of the grind table 220 and the grind chuck 230. In addition, elements having basically the same function as previously described elements of the wafer grinding machine 100 according to the first embodiment of the present invention are identified using common reference numerals throughout the drawings, and the detailed description thereof is omitted below.

Figure 5:
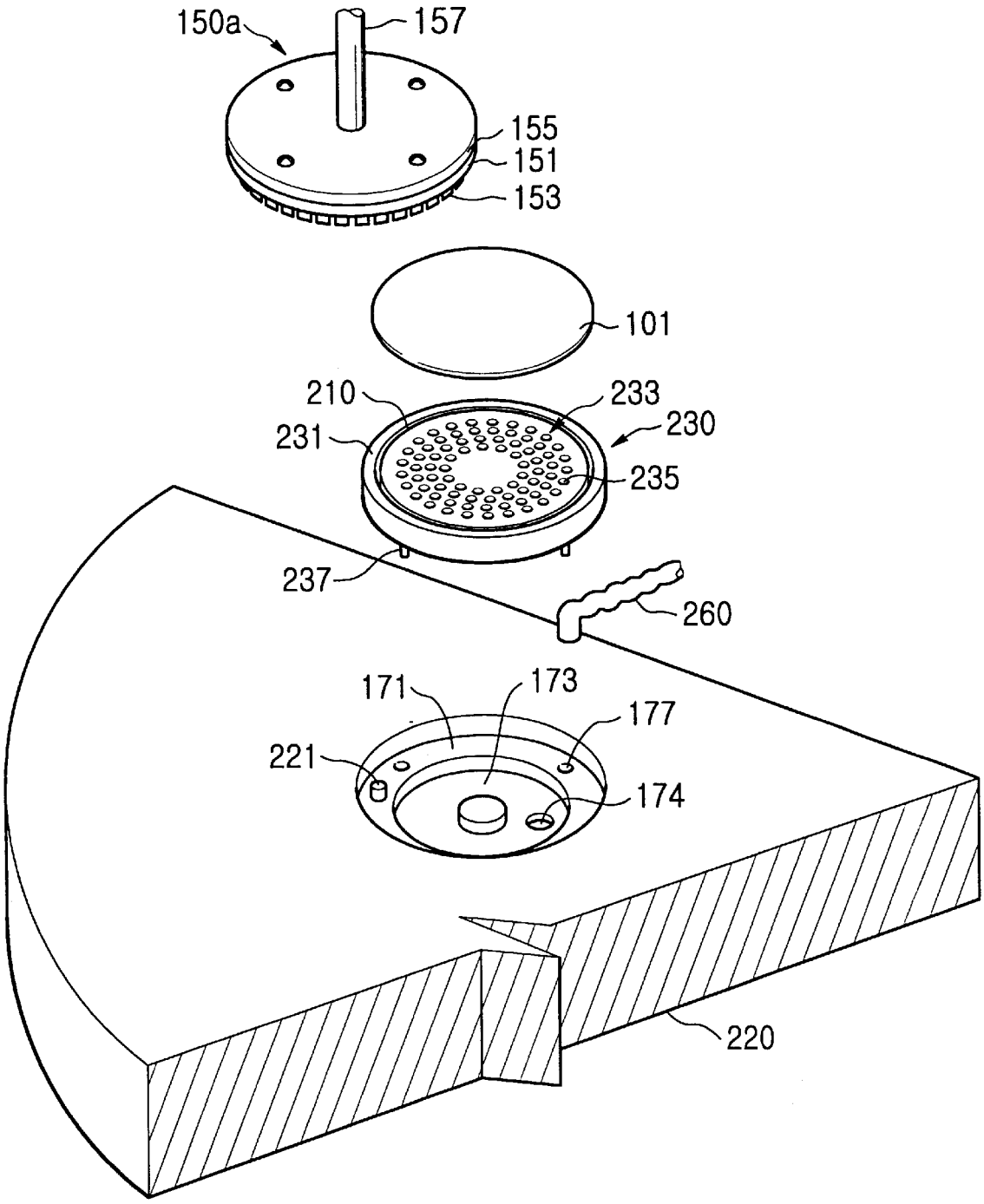
FIG. 5 is an exploded perspective view, partially cut away, of the grind table, grind chuck and grind unit of the wafer grinding machine as shown in FIG. 4.
Figure 6:
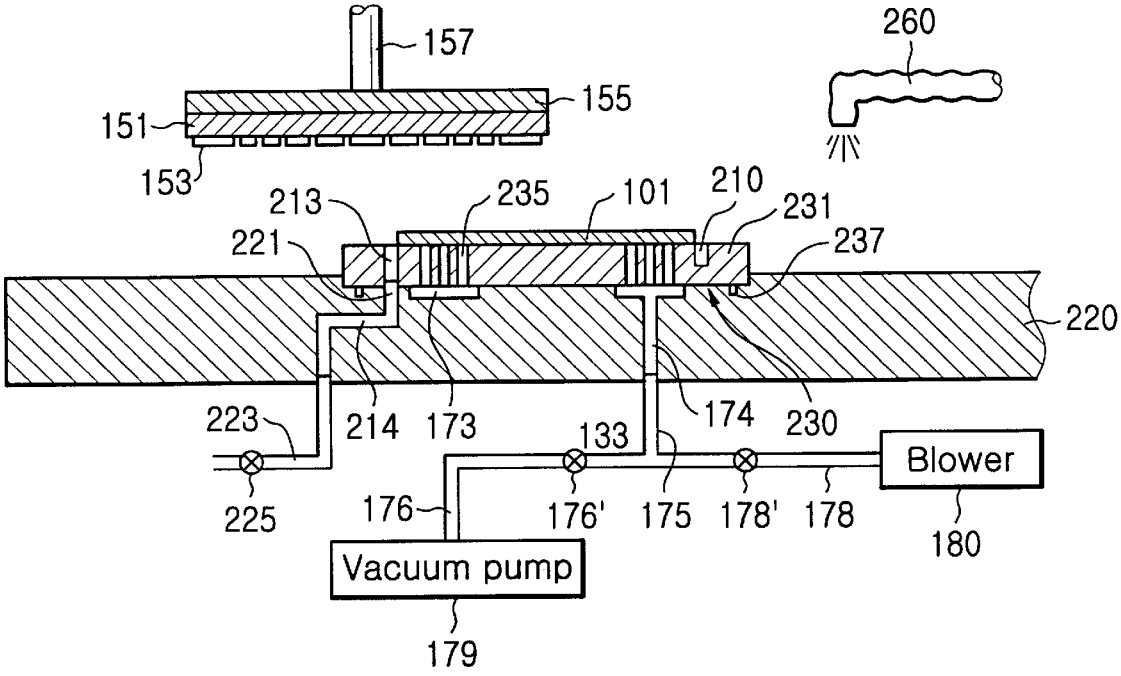
FIG. 6 is a cross-sectional view taken along lines 6—6 in FIG. 4.

As shown in FIGS. 5 and 6, the grind chuck 230 comprises: a body 231 having a predetermined thickness and a shape corresponding to the wafer 101; a ring-shaped porous portion 233 formed in the central region of the body 231 and including a plurality of suction pores 235; and a ring-shaped rising groove 210 formed along the periphery of the body 231, for discharging fluid therethrough to protect the front face of the wafer 101 from being contaminated by silicon dust; a rise hole 213 formed in the bottom of the rising groove 210 through the body 231, and coupling projections 237 formed on the bottom of the body 231, for use in fixing the grind chuck 230 to the grind table 220. The grind chuck 230 is formed of a soft material having a high elastic modulus so that the semiconductor chips are protected from being pressed by the first and second grind units 150*a* and 150*b*. Preferably, the soft material having a high elastic modulus is polytetrafluoruethylene or rubber. In addition, preferably, the inner diameter of the rising groove 210 is the same as or a little smaller than the diameter of the wafer 101.

As shown in FIG. 5, a grind chuck accommodating groove 171 for accommodating the grind chuck 230 is formed in the grind table 220. Coupling grooves 177 corresponding to the respective coupling projections 237 are formed in the bottom of the grind chuck accommodating groove 171.

In addition, corresponding to the porous portion 233, an intake and exhaust groove 173 having a predetermined depth is formed in the grind chuck accommodating groove 171. An intake and exhaust hole 174 is formed in the intake and exhaust groove 173 through the grind table 220. As shown in FIG. 6, an end of an intake and exhaust duct 175 is inserted into the intake and exhaust hole 174. The other end of the intake and exhaust duct 175 is divided into two branches: one is a vacuum duct 176 connected to a vacuum pump 179; and the other is an air supply duct 178 connected to a blower 180. Opening and closing valves 176' and 178' are installed in the vacuum duct 176 and the air supply duct 178, respectively.

In addition, corresponding to the rise hole 213, a fluid supply duct 214 is provided in the grind chuck accommodating groove 171 through the grind table 220. A connecting duct 221 for connecting the fluid supply duct 214 to the rise hole 213 projects from the bottom of the grind chuck accommodating groove 171. The other end of the fluid supply duct 214 that is not connected to the rise hole 213 is connected to a deionized water supply duct 223 or to the blower 180 (this latter connection not shown). Reference number 225 designates an opening and closing valve for opening and closing the fluid supply duct 214. Preferably, fluid supplied through the fluid supply duct 214 is air or deionized water.

The operation of the wafer grinding machine 200 will be described hereinafter. First, a wafer 101 with semiconductor chips formed on the front face thereof is loaded onto the grind chuck 230 mounted on the grind table 120 outside of the process chamber 110 in such a manner that the front face of the wafer 101 with the semiconductor chips is in contact with the surface of the grind chuck 230, and the periphery of the wafer 101 partially overlaps the rising groove 210 as shown in FIG. 6.

When the wafer 101 is loaded onto the grind chuck 230, the opening and closing valve 176' installed in the vacuum duct 176 is opened to create a vacuum in the intake and exhaust duct 175. When the intake and exhaust duct 175 is in the vacuum state, the pores 235 of the porous portion 233 formed at a location corresponding to the intake and exhaust groove 173 hold the wafer 101 on the grind chuck 230 by vacuum suction force.

When the wafer 101 is held on the grind chuck 230, the grind table 120 is rotated 90 degrees in the clockwise direction. The grind chuck 230 is thereby moved to the first grind unit 150*a* installed in the process chamber 110.

Thereafter, deionized water having a resistivity of 16 MΩ is sprayed onto the rear face of the wafer 101 through the deionized water supply duct 260 to remove heat generated while the rear face of the wafer 101 is ground. At the same time, deionized water is sprayed from the fluid supply duct 214 by opening the opening and closing valve 225, so that silicon dust generated during grinding does not come into contact with the front face of the wafer 101, such that the front face of the wafer 101 is not contaminated by silicon dust. When the opening the closing valve 225 is opened, the fluid, e.g., deionized water, flows toward the rising groove 210 through the fluid supply duct 214, in the opposite direction of the spray direction of the deionized water coming from the deionized water supply duct 260. The pressure of the deionized water rising in the rising groove 210 is limited, so that the wafer is not released from the suction holding it onto grind chuck 230.

Thereafter, the wheel 155 coupled with the grinder 151 is rotated at a velocity of approximately 300 rpm and the first grind unit 150*a* is moved downwardly to the wafer 101 held on the grind chuck 230 by operation the motor of the first grind unit 150*a*. When the diamond resins 153 are brought into contact with the rear face of the wafer 101, the rear face of the wafer 101 is ground by the pressure of the first grind unit 150*a* and the rotation power of the grinder 151 since the diamond resins 153 are harder than silicon. Through the first grinding step, the wafer 101 originally having a thickness of approximately 720 μm is ground to a first thickness, e.g., a thickness of approximately 420 μm. At this time, since the grinder 151 rotates at a slow velocity of 300 rpm, the first grinding step leaves the ground rear face of the wafer 101 rough.

While the rear face of the wafer 101 is being ground by the diamond resins 153, silicon dust is generated. The generated silicon dust is picked up by the deionized water sprayed onto the wafer and flows over the periphery of the wafer 101. In addition, deionized water flows upward in the rising groove 210 from the rising hole 213 and serves as a protective layer for the front face and the side of the wafer 101. The deionized water from the rising hole 213 and the deionized water carrying the silicon dust flow toward the grind table 22. As a result, the deionized water with the silicon dust is prevented from contacting the front face of the wafer 101. Alternatively, when air is supplied through the fluid supply duct 214 to the rising hold 213, the deionized water with silicon dust is pushed up toward the rear face of the wafer 101 by the air rising in the rising groove 210. Accordingly, the deionized water with silicon dust is prevented from contacting the front face of the wafer 101.

When the wafer 101 is completely ground to the first thickness, i.e., to the thickness of 420 μm, the grind table 120 is rotated 90 degrees and thereby the first-ground wafer 101 is transferred to a location beneath the second grind unit 150*b*. Thereafter, the motor of the second grind unit 150*b* is operated to thereby rotate the wheel 155 coupled with the grinder 151 at a velocity of approximately 2000 rpm and move the second grind unit 150*b* downwardly to the wafer 101 placed on the grind chuck 230. When the second grind unit 150*b* is moved down, the diamond resins 153 of the grinder 151 are brought into contact with the rear face of the wafer 101 and grind the rear face of the wafer 101 to a thickness of 380 μm. At this time, since the grinder 151 rotates at a high velocity of 2000 rpm, the rear face of the wafer 101 is evenly ground.

Thereafter, the grind table 120 is rotated 90 degrees to carry the second-ground wafer 101 out of the process chamber 110. Then, the opening and closing valve 176' installed in the vacuum duct 176 is closed and the opening and closing valve 178' installed in the air supply duct 178 is opened. As a result, air is supplied through the intake and exhaust duct 175. When the air is supplied through the intake and exhaust duct 175 and the pores 235 of the porous portion 233, the wafer 101 is released from the grind chuck 230. Then, the completely ground wafer 101 is unloaded.

As described with the first and the second embodiments, the grind chuck is formed of a soft material having a high elastic modulus so that the pressure of the grind unit onto the wafer can be adsorbed by the grind chuck. As a result, the semiconductor chips formed on the front face of the wafer are not damaged by the pressure of the grind unit when the rear face of the wafer is being ground by the grind unit.

As aforementioned, according to the present invention, the rear face of the wafer is ground without attaching an ultraviolet tape to the front face of the wafer where semiconductor chips are formed, which results in reduced manufacturing costs and a simplified process. Furthermore, the semiconductor chips can be protected from being damaged by static electricity which may occur when the ultraviolet tape rubs against other objects.

In addition, a rising groove for rising fluid therein is formed in the grind chuck and the grind chuck is formed of a soft material having a high elastic modulus. Thereby, deionized water with silicon dust is prevented from contacting the front face of the wafer and the semiconductor chips formed thereon, and the semiconductor chips are not damaged by the pressure of the grind unit.

While preferred embodiments of the present invention have been illustrated and described, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An apparatus for grinding wafers comprising:

a process chamber providing a space for performing a wafer grinding process;

a grind table installed partially inside and partially outside of said process chamber;

a plurality of grind chucks mounted on said grind table for holding said wafer by a vacuum suction force, wherein each grind chuck comprises a body having a predetermined thickness and a shape corresponding to said wafer, a ring-shaped porous portion formed in a central region of said body and having a plurality of pores, and a ring-shaped rising groove formed in a peripheral portion of said body;

a deionized water supply duct for spraying deionized water onto said wafer;

a first grind unit for grinding said wafer to a first thickness;

a second grind unit for grinding said wafer to a second thickness;

a grind chuck accommodating groove formed in said grind table for accommodating said grind chuck;

an intake and exhaust groove formed in said grind chuck accommodating groove corresponding to said porous portion of the grind chuck;

a fluid supply duct formed in said grind table, said fluid supply duct being connected to a rise hole formed through said body, said rise hole being connected to said rising groove; and a vacuum pump and a blower connected to said intake and exhaust groove through an intake and exhaust hole formed through said grind table.

2. The apparatus of claim 1, wherein said first and said second grind units rotate on their own axes and revolve about a central axis of said grind chuck.

3. The apparatus of claim 1, further comprising a connecting duct connecting said fluid supply duct to said rise hole, said connecting duct projecting from a bottom of said grind chuck accommodating groove.

4. The apparatus of claim 1, wherein a plurality of coupling projections are formed on a bottom of said body of the grind chuck, and a plurality of coupling grooves corresponding to said respective coupling projections are formed in a bottom of said grind chuck accommodating groove.

5. The apparatus of claim 1, wherein an inner diameter of said rising groove is equal to or smaller than a diameter of said wafer.

6. The apparatus of claim 1, wherein deionized water is supplied through said fluid supply duct.

7. The apparatus of claim 6, wherein said deionized water has a resistivity of 16 MΩ.

8. The apparatus of claim 1, wherein air is supplied through said fluid supply duct.

9. The apparatus of claim 1, wherein said grind chuck is formed of a material having a high elastic modulus.

10. The apparatus of claim 9, wherein said material is polytetrafluoruethylene.

11. The apparatus of claim 9, wherein said material is rubber.

* * * * *